US005291910A

United States Patent [19]

Bui et al.

[11] Patent Number: 5,291,910

[45] Date of Patent: Mar. 8, 1994

[54] ADJUSTABLE HAND GRIP FOR ORTHOPEDIC CRUTCH

[75] Inventors: Cuong Bui, Yorba Linda; Jim R. Schultz, Thousand Oaks, both of Calif.

[73] Assignee: Guardian Products, Inc., Simi Valley, Calif.

[21] Appl. No.: 1,830

[22] Filed: Jan. 8, 1993

Related U.S. Application Data

[63] Continuation-in-part of Ser. No. 881,531, May 12, 1992.

[51] Int. Cl.[5] ..... A61H 3/02

[52] U.S. Cl. ..... 135/68; 135/72; 403/391; 403/378

[58] Field of Search ..... 135/68, 72, 76, 65; 403/391, 396, 377, 378, 379, 380, 109

[56] References Cited

U.S. PATENT DOCUMENTS

| | | | |
|---|---|---|---|
| 596,203 | 12/1897 | Drake . | |
| 705,741 | 7/1902 | Drew . | |
| 904,481 | 11/1908 | Hood . | |
| 1,225,364 | 5/1917 | Sanders . | |
| 1,253,117 | 1/1918 | Allen . | |
| 2,110,397 | 3/1938 | Kangas | 403/378 X |
| 2,669,244 | 2/1954 | Greene et al. . | |
| 2,793,647 | 5/1957 | Urie et al. . | |
| 3,335,735 | 8/1967 | Colegrove et al. . | |
| 3,768,495 | 10/1973 | Smith . | |
| 4,627,761 | 12/1986 | Olson et al. | 403/378 X |
| 4,647,241 | 3/1987 | Weber | 403/205 X |
| 4,979,533 | 12/1990 | Hansen et al. . | |

OTHER PUBLICATIONS

A portion of an undated brochure showing elbow crutches manufactured by Gauthier-Villot and believed to be sold by Walk Easy, Inc.

*Primary Examiner*—Carl D. Friedman
*Assistant Examiner*—Lan C. Mai
*Attorney, Agent, or Firm*—Willian Brinks Hofer Gilson & Lione

[57] ABSTRACT

An adjustable hand grip that can slide along the vertical supports of an orthopedic crutch is provided. The hand grip can be easily fixed to the supports at different vertical elevations to accommodate the user by providing a sleeve that surrounds and slides over each vertical support. Each sleeve has an aperture that can be aligned with the apertures in the vertical support. A bracket that extends between the vertical supports rigidly connects the sleeves. A locking member for locking the sleeve to a vertical support is provided and comprises a generally U-shaped clamp that surrounds a portion of the sleeve and a pin that can be inserted through aligned apertures in the sleeve and vertical support so that the hand grip is firmly fixed to the vertical support.

40 Claims, 6 Drawing Sheets

ADJUSTABLE HAND GRIP FOR ORTHOPEDIC CRUTCH

The present application is a continuation-in-part of pending application Ser. No. 07/881,531 filed on May 12, 1992 for an Orthopedic Crutch with Adjustable Hand Grip.

BACKGROUND OF THE INVENTION

The present invention relates to an adjustable hand grip for an orthopedic crutch.

Many different orthopedic crutches have been designed and manufactured to assist injured and handicapped individuals. Since individual users vary in height, efforts have been made to design and construct orthopedic crutches which are adjustable to the height of the user. For example, U.S. Pat. No. 4,979,533 discloses a crutch having an adjustable hand grip with locking buttons biased outwardly by a spring to engage holes located in an adjustment mechanism.

For the most part such orthopedic crutches tend to require complex adjustment mechanisms and procedures to accomplish the hand grip adjustment. Moreover, in some cases, the hand grip when adjusted does not provide a feeling of security and stability for the user. Accordingly, while the hand grip should be adjustable it must also be stable.

The present invention provides an adjustable hand grip for an orthopedic crutch which is simple and easy to operate by the user without the need of assistance and which is stable and secure.

SUMMARY OF THE INVENTION

According to the invention there is provided an orthopedic crutch comprising a pair of spaced apart, generally parallel vertical, preferably tubular, supports rigidly attached to one another, an arm support attached to the upper end of the vertical supports and a vertically adjustable hand grip fixable to the vertical supports. Each of the vertical supports has a plurality of spaced apart apertures along one longitudinal surface. The hand grip comprises means, such as tubular sleeves, surrounding each vertical support and slidable thereover and a bracket extending between the vertical supports and rigidly connecting the sleeves. The sleeves accommodate a locking member extending through an aperture in the sleeve adjacent the vertical support.

In the preferred embodiment, the sleeves are provided with an aperture alignable with apertures in the vertical supports. The locking member for locking the sleeve to a vertical support comprises a generally U-shaped clamp which surrounds a portion of the sleeve and a pin fixed to the clamp. The legs of the U-shaped clamp are biased into contact with the sleeve, such as by being slightly undersized with respect to the sleeve's diameter, at least at the ends thereof. The pin, which is fixed to the clamp, is moveable into and out of the apertures in the sleeve and vertical support when it is aligned by moving the clamp toward or away from the vertical supports.

In another embodiment of the invention, an adjustable hand grip having a locking member is provided for a crutch having a pair of generally parallel, vertical supports rigidly attached to another, with each of the supports having a plurality of spaced apertures along a longitudinal surface. The hand grip comprises a sleeve that surrounds and slides over each vertical support.

Each sleeve has an aperture that can be aligned with the apertures in the vertical support. A bracket that extends between the vertical supports rigidly connects the sleeves. The locking member for locking the sleeve to a vertical support comprises a generally U-shaped clamp that surrounds a portion of the sleeve and a pin that can be inserted through aligned apertures in the sleeve and vertical support so that the hand grip is firmly fixed to the vertical supports. Preferably, the legs of the U-shaped clamp are biased into contact with the sleeve, such as by being slightly undersized with respect to the sleeve's diameter, at least the ends thereof.

DETAILED DESCRIPTION OF THE DRAWINGS

DETAILED DESCRIPTION OF THE PREFERRED EMBODIMENTS

Figure 1:
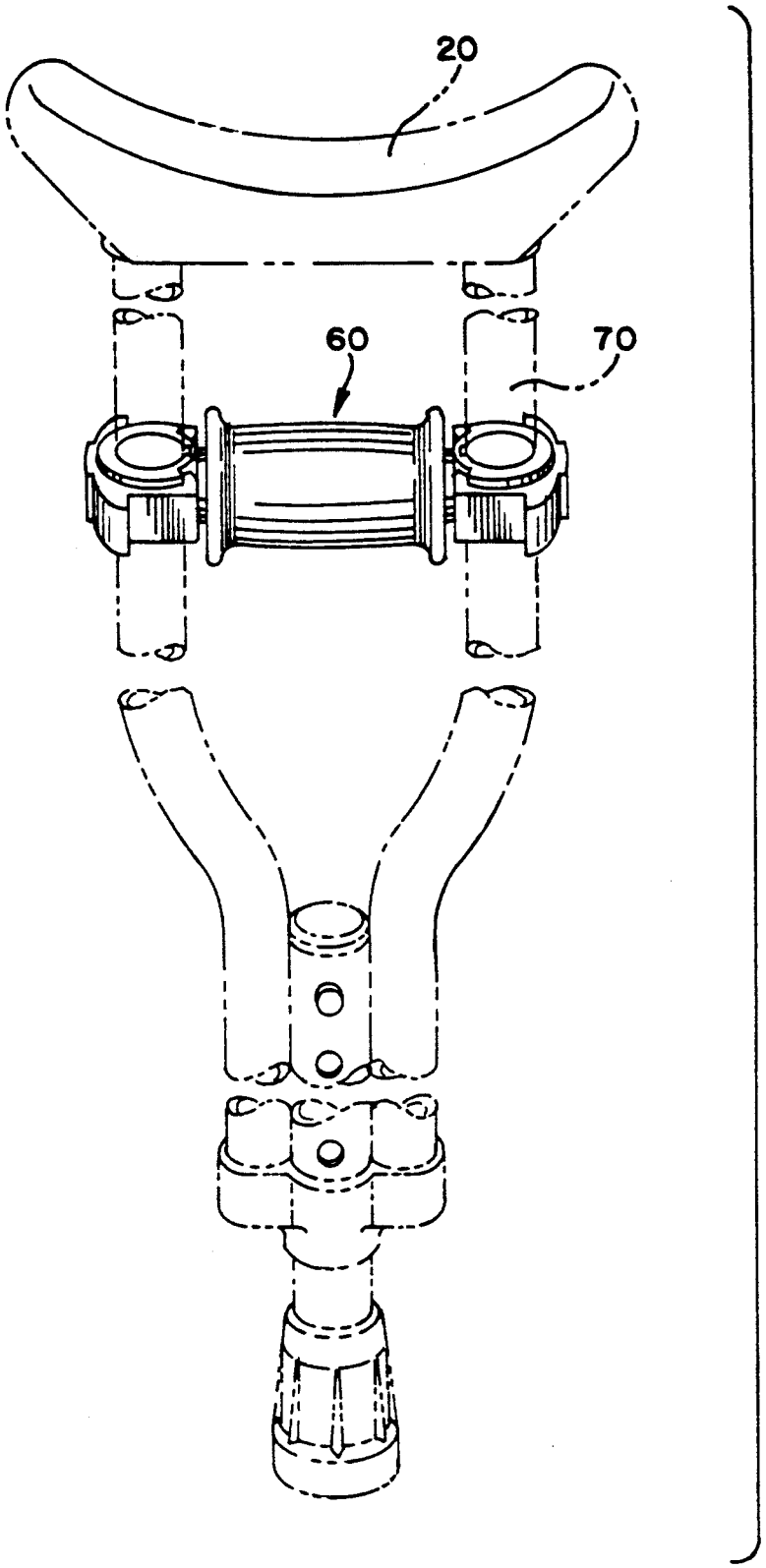
FIG. 1 is a perspective view showing the adjustable hand grip mounted on an orthopedic crutch and shows the locking member in an engaged position with respect to the vertical supports.

One embodiment of the invention is shown in FIGS. 1–6 of the drawings. In this embodiment, there is provided an orthopedic crutch which comprises a pair of generally parallel, vertical supports 70 rigidly attached to one another, an arm support 20 attached to the upper ends of the vertical supports and an adjustable hand grip 60. Preferably, the supports 70 are tubular. Alternatively, the supports 70 may be wooden or manufactured from an extruded polymeric material. Apertures 12 are provided by any known means on a longitudinal surface of the vertical supports 70.

The hand grip 60 comprises a bracket 62 rigidly connecting sleeves 64 which are longitudinally slidable on the vertical supports 70. Of course, the inner circumference of the sleeves 64 generally conform to the shape of the vertical supports 70. Advantageously, the sleeve 64 and bracket 62 may comprise a unitary molded plastic member of suitably rigid plastic material such as polypropylene. More preferably, the sleeve 64 and bracket 62 comprise a unitary plastic member molded from a nylon polymer.

Figure 2:
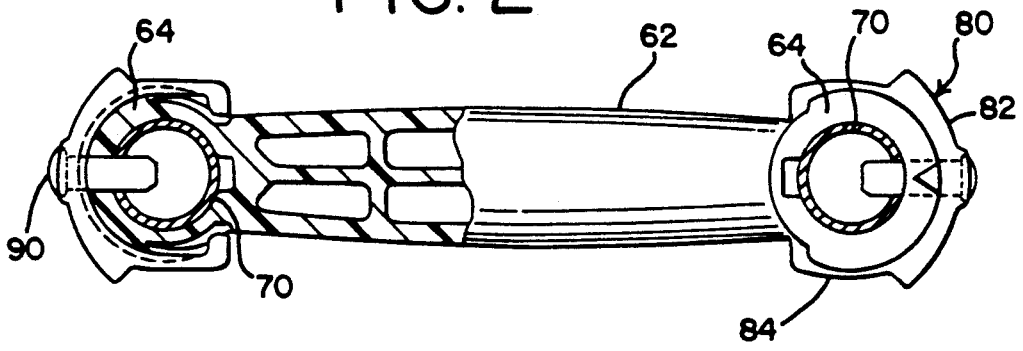
FIG. 2 is a partial perspective view the adjustable hand grip of the present invention with the locking member in the engaged position.
Figure 3:
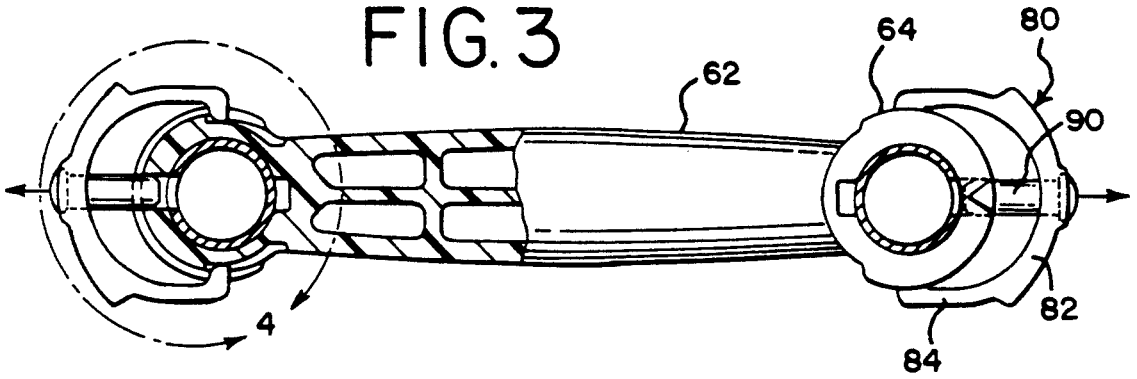
FIG. 3 is a top view with a partial cut-away in cross section showing the locking member of FIG. 2 disengaged.
Figure 4:
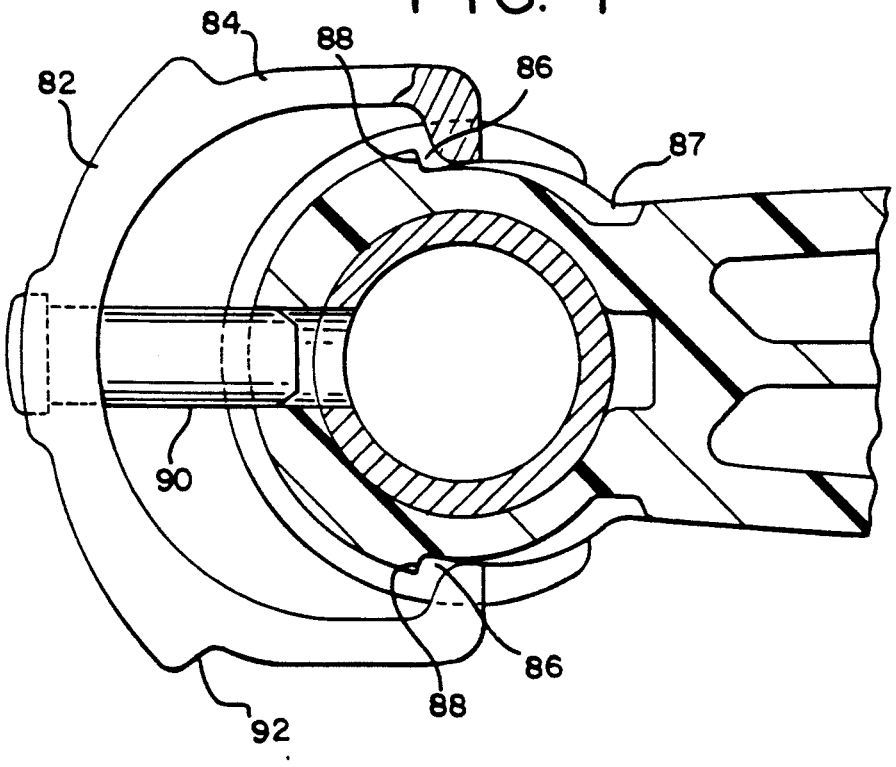
FIG. 4 is an enlarged top view similar to FIG. 3 showing the locking member in the disengaged position.
Figure 5:
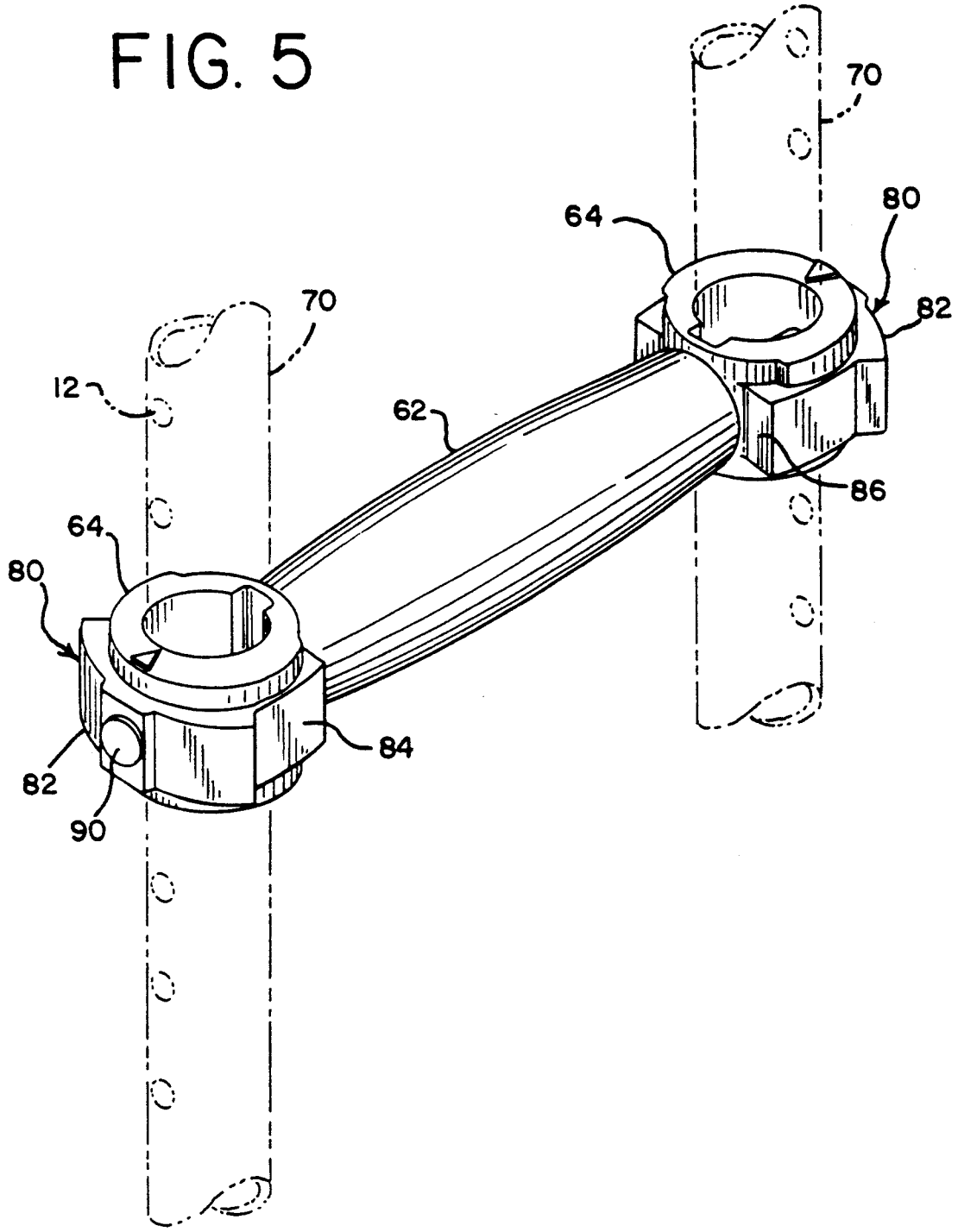
FIG. 5 is a perspective view showing, the locking member handle assembly engaged on the crutch.
Figure 6:
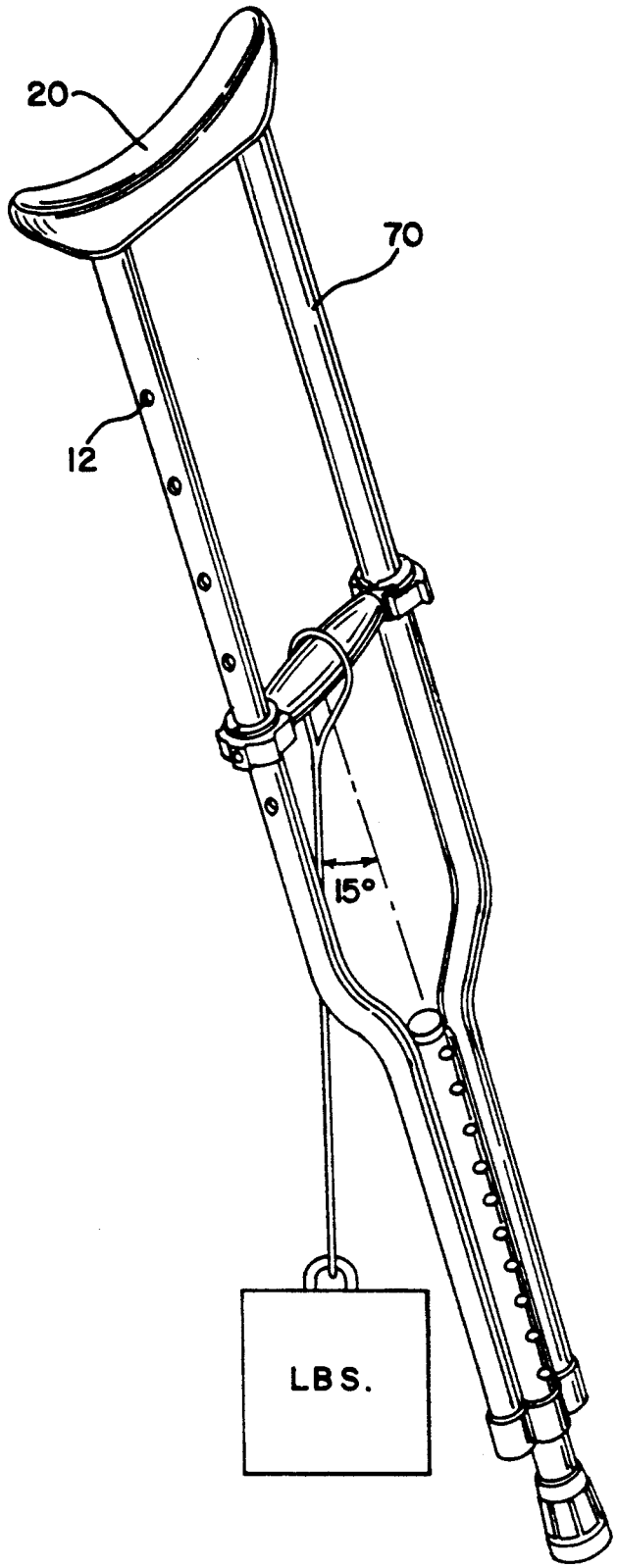
FIG. 6 is a perspective schematic showing the static load and dynamic load testing of the hand grip of FIG. 1.

The locking member 80 comprises a generally U-shaped clamp 82 having legs 84 which surround at least a portion of sleeve 64 and a pin 90 preferably having a lead angle. The pin 90 is preferably metal and is fixed to clamp 82. FIGS. 2 and 5 show the hand grip locking member 80 in the engaged or locked position. FIGS. 3 and 4 show the locking member 80 in the disengaged position. The clamp 82 is preferably a unitary molded plastic member having suitable toughness such as polyethylene, more preferably high density polyethylene.

The U-shaped clamp 82 is sized to snugly embrace sleeve 64 so that at least a portion of the legs 84 are biased against the tubular sleeve in a manner which creates an over center lock condition relative to the sleeve 64 when the locking member is in the engaged position. Projections 86 are advantageously provided at the end of the legs 84, best seen in FIG. 4, to make firm contact with the external surface of sleeve 64. The projections 86 are biased into contact with the sleeve 64 by, for example, being slightly undersized with respect to the outside diameter of the sleeve. A slight depression 87 may be formed at the external surface of the sleeve or junction of the sleeve and bracket to receive the projection 86 when the clamp 82 is in the engaged position, as shown in FIG. 2, with the locking pin 90 inserted through aligned apertures in sleeves 64 and vertical supports 70.

Of course, since the clamp 82 is preferably molded of plastic having a suitable toughness, the legs are flexible and can be moved out of the engaged position to the disengaged position best seen in FIG. 4 as will be described later. When the locking member or device 80 is in the engaged position, a portion of the legs are in an over center lock position, best seen in FIG. 2 so that the hand grip 60 and bracket 62 are firmly supported between vertical supports 70 and can sustain the weight of the user of the crutch.

The pin 90 is preferably metallic since it engages the vertical supports which are also generally, and preferably, of metallic material. The pin 90 also preferably has a lead angle so that the pin may be easily received by the apertures 12 in the sleeves and vertical supports. Apertures 12 in the vertical supports may be either drilled, mandrel punched or preferably free punched. As indicated previously, the pin 90 is fixed to the clamp 82, preferably to the base of the clamp, such as by being fixed in situ during the molding of the plastic clamp, or the pin can be threaded to the clamp or fixed by an upset knurl or barb, or retained by a nut or lock washer. In another embodiment, shown in FIGS. 7A and 7B, the locking member 80 is integrally molded of plastic so that the clamp 82 and pin 90 are one piece. Preferably, the plastic has suitable toughness, hardness and shear strength such as an amorphous urethane, for example ISO PLAST 101 TM manufactured by Dow Chemical Co. In another embodiment, shown in FIG. 8, the clamp 82 is further provided with a shoulder 94 to provide further support to the pin 90. Of course, in this embodiment, the pin may be metallic and fixed to the clamp or may be integrally molded with the clamp, as described above.

Preferably, the pin 90 extends only a portion of the distance toward the legs 84. More preferably, the pin 90 has a length so that when the clamp 82 is in the engaged position, the pin 90 extends through the aperture 12 into the vertical tubular support 70. Most preferably, the pin has a length of about 0.5 inches.

Since a majority of the crutch user's weight is to be supported by the hand grip 60, it is important that the hand grip, the bracket, the clamp, the pin, and other components be able to sustain a minimum static load to ensure that they will not fail under the load of the user. In other words, the hand grip, the bracket, the clamp, the pin, and other components should be able to withstand this minimum static load when the clamp is in the engaged position, as shown in FIG. 5, with the locking pin inserted through aligned apertures in sleeves 64 and vertical supports 70.

Preferably, the hand grip 60 should be able to withstand this minimum static load at each of the vertical positions of the hand grip 60. Static load testing on the hand grip may be performed with the crutch oriented in a substantially vertical position. This position, however, does not accurately reflect the alignment of the crutch during the user's locomotion. Accordingly, it is preferred that static loading tests on the hand grip be performed when the crutch is oriented at about 15° from the vertical (see FIG. 6). Preferably, the hand grip in the present embodiment should withstand a minimum static load of at least 100 pounds, preferably, at least 150 pounds, more preferably, at least 200 pounds with the load applied vertically while the crutch is oriented at about 15° from the vertical without exhibiting any flexing of the vertical supports, damage to the hand grip, or undue enlargement of the apertures.

It is also important that the hand grip of the present embodiment be able to withstand the anticipated cyclical dynamic stresses applied by the user during locomotion without causing excessive enlargement of the apertures provided in the vertical supports 70 or fatigue of related components. Such enlargement may cause the user to feel that the hand grip is unstable. Accordingly, it is preferred that the hand rip withstand a load of at least 100 pounds, more preferably, at least 200 pounds when the crutch is oriented at about 15° from the vertical for a minimum of 200,000 cycles without excessive enlargement of the apertures, fatigue, failure, or damage to the hand grip, or other components of the crutch. Preferably, the apertures 12 provided in the vertical supports 70 do not enlarge more than about 0.015 of an inch after the above described cyclic loading.

To adjust the vertical elevation of the hand grip 60 with respect to the arm rest 20, to accommodate the user, the locking member 80 may be disengaged from the vertical supports 70 by applying pressure with fingers to finger rests 92 to pull or push the clamp 82 outwardly, or to the end of legs 84, so that the locking pin 90 is moved out of the vertical supports 70 into the position shown in FIG. 4, thereby permitting the hand grip 60 to longitudinally slide on the vertical supports 70. When the 82 clamp is disengaged from the locking position, projections 86 will come to rest against stop means 88 provided on the external surface of the sleeve 64 to limit outward movement of the clamp 82 when it is moved from the engaged to the disengaged position. When the hand grip 60 is in a suitable position for the user, the pin 90 may be moved to the locking position by moving the clamp 82 toward the vertical support 70 as shown in FIG. 2 so that the pin 90 is moved through the closest aligned apertures in the sleeve 64 and into vertical tubular support 70.

Preferably, the clamp 82 is such that the user is not required to exert undue force to disengage the locking member while at the same time the locking member must not inadvertently "pop out" or become disengaged from the vertical supports. The force to disengage the locking member is preferably at least about 0.5 pounds, most preferably from about 0.5 to about 10 pounds.

The locking member must also be able to be easily engaged in a locking position. Preferably, the force to engage the locking member is at least about 0.1 pounds, most preferably from about 0.1 to about 5 pounds.

In accordance with the most preferred embodiment, the force or effort required to disengage the locking member is greater than the force or effort required to engage the locking member. More preferably, the ratio of the force required to disengage the locking member to the force required to engage the locking member is from 2:1 to 5:1.

When the pin is metallic and is fixed to the clamp, it is desired that the pin 90 does not inadvertently become dislodged from the locking member 80. Accordingly, it is preferred that the force required to dislodge the pin 90 from the locking member 80 be at least 10 pounds, more preferably at least 30 pounds. Most preferably, the force required to dislodge the pin 90 from the locking member ranges from about 65 to about 300 pounds. At the same time, the pin 90 must not be too difficult to fit in the locking member 80 or the apertures 12. Accordingly, as noted above, the pin 90 is tapered or beveled at the end received by the apertures to provide a lead angle so that the pin 90 may be more easily inserted into the apertures provided in the sleeves and the supports.

Figure 7A:
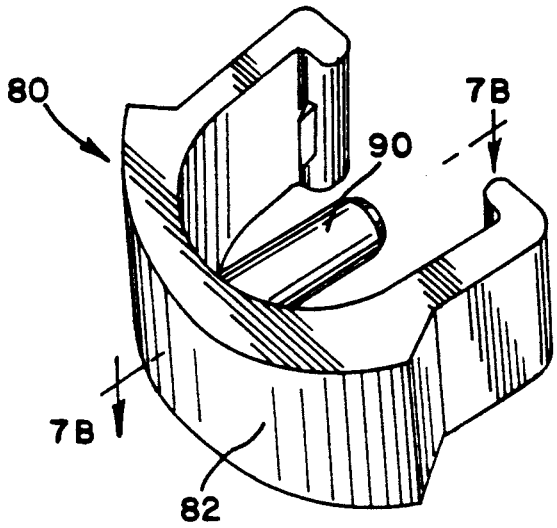
FIG. 7A is a perspective view of an alternative embodiment of the locking member.
Figure 7B:
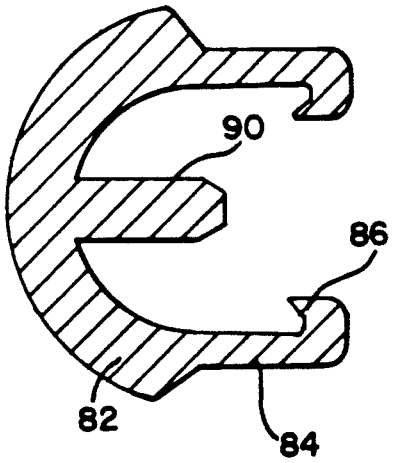
FIG. 7B is a cross-sectional view of the locking member of FIG. 7A along line 7B—7B.
Figure 8A:
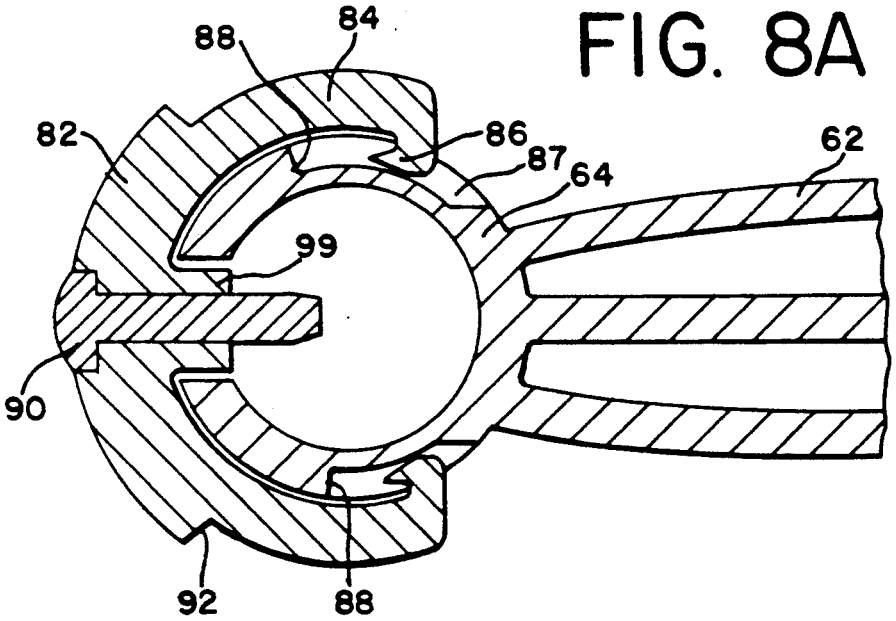
FIG. 8A is a cross-sectional view of a portion of the adjustable hand grip with an alternative embodiment of the locking member shown in an engaged position.
Figure 8B:
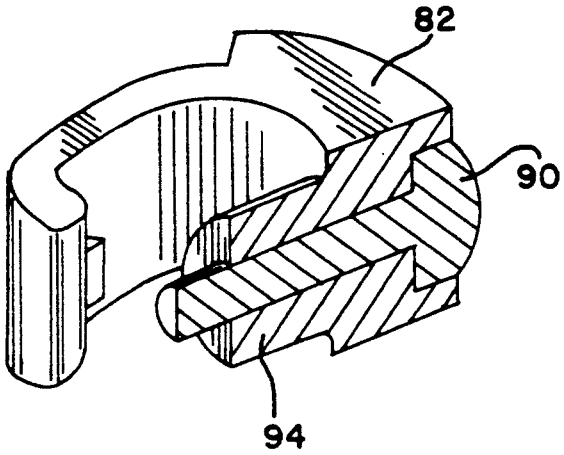
FIG. 8B is a perspective view of the locking member of FIG. 8A with a portion cut-away.
Figure 9:
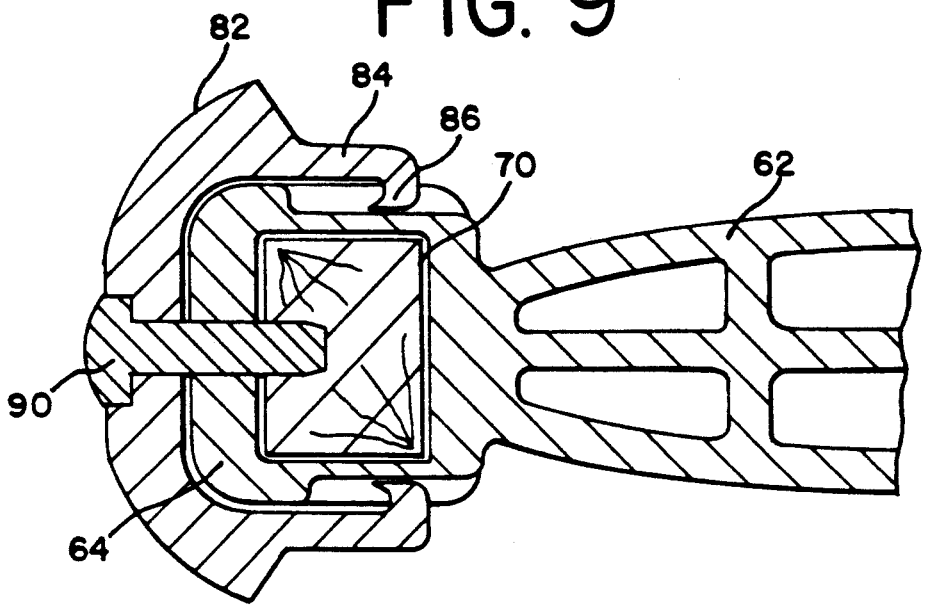
FIG. 9 is a top cross-sectional view of the adjustable hand grip with an alternative embodiment of the locking member useful on a wooden vertical support.

In another embodiment of the invention, shown in FIG. 9, the vertical supports 70 are manufactured from wood. Of course in this embodiment each of the vertical wood supports are provided with apertures on a longitudinal surface by any known means. Although FIG. 9 shows a locking member 80 similar to that used for vertical tubular supports, the locking member may have any suitable shape and construction including that as shown in FIGS. 7A and 8A. It is also understood that the hand grip 60, particularly the sleeve 64, may have a differently shaped inner circumference suitable to slidably engage the wooden vertical support.

Figure 10:
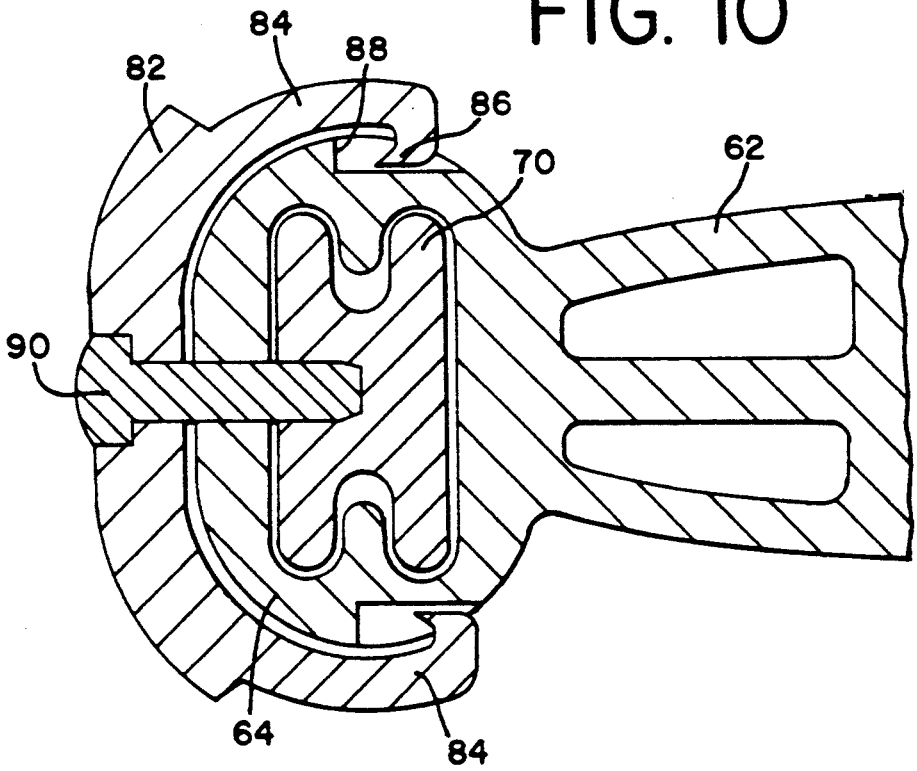
FIG. 10 is a top cross-sectional view of the adjustable hand grip with an alternative embodiment of the locking member useful on an extruded polymer vertical support.

In another embodiment, shown in FIG. 10, the vertical supports 70 are manufactured from an extruded polymer or are integrally molded from plastic. In this embodiment, each of the vertical supports 62 are provided with apertures on a longitudinal surface by any known means. Desirably, as best seen in FIG. 10, the portion of the vertical support that slidably receives the sleeve 64 is contoured to provide a mating relationship with the sleeve 64 of the hand grip 60.

It is apparent from the foregoing that various changes and modifications may be made to the adjustable hand grip including the locking member according to the present invention without departing from the scope thereof. Accordingly, the scope of the invention should be limited only by the appended claims wherein what is claimed is:

We claim:

1. An adjustable hand grip having a locking member in combination with for an orthopedic crutch with a pair of generally parallel, vertical supports rigidly attached to one another, with each of the supports having a plurality of spaced apertures along a longitudinal surface comprising:

a. a sleeve slidably surrounding each vertical support, each sleeve having an aperture that can be aligned with the apertures in the vertical support;

b. a bracket extending between the vertical supports to rigidly connect the sleeves; and c. a clamp surrounding a portion of the sleeve and having a pin insertable through aligned apertures in the sleeve and the vertical support and movable into and out of the aligned apertures, the clamp firmly fixing the hand grip to the vertical supports when the pin is extended through the aligned apertures in the sleeve and vertical support.

2. The adjustable hand grip according to claim 1 wherein the clamp is generally U-shaped with at least a portion of the legs being biased against the tubular sleeve.

3. The adjustable hand grip according to claim 2 wherein the portions of the legs of the U-shaped clamp that are biased against the sleeve comprise projections on the legs that extend inwardly.

4. The adjustable hand grip according to claim 3 further comprising stop means on the external surface of the sleeve which the projections on the clamp engage to limit the extent of movement of the clamp when said pin is moved out of the aperture in the vertical support.

5. The adjustable hand grip according to claim 4 further comprising finger rest means on the external surface of the clamp against which force may be applied to move the clamp away from the vertical support so as to move the pin out of the aperture in the vertical support.

6. The adjustable hand grip according to claim 5 wherein said clamp comprises a plastic material and said pin is metallic and is fixed to the clamp.

7. The adjustable hand grip according to claim 6 wherein the force required to displace the pin from the clamp is at least 10 pounds.

8. The adjustable hand grip according to claim 1 wherein said clamp and pin are unitary and integrally molded of plastic.

9. The adjustable hand grip according to claim 1 wherein the force required to move the pin out of the aperture in the vertical support is greater than the force required to move the pin into the aperture in the vertical supports.

10. The adjustable hand grip according to claim 9 wherein the force required to move the pin out of the aperture in the vertical support is at least about 0.5 pounds and the force required to move the pin into the aperture in the vertical support is at least about 0.1 pounds.

11. The adjustable hand grip according to claim 1 wherein the ratio of the force required to move the pin out of the aperture in the vertical support to the force required to move the pin into the aperture in the vertical supports ranges from 2:1 to 5:1.

12. An adjustable hand grip according to claim 1 wherein the hand grip can withstand a static load of about 100 pounds with the load applied in the vertical direction while the crutch is oriented at about 15 degrees from the vertical.

13. An adjustable hand grip according to claim 1 wherein the apertures provided in the vertical supports can withstand a cycle loading of about 100 pounds applied vertically to the hand grip while the crutch is oriented at about 15 degrees from the vertical for a minimum of 200,000 cycles without excessive enlargement.

14. An adjustable hand grip according to claim 1 wherein the vertical supports are tubular.

15. An adjustable hand grip according to claim 1 wherein the vertical supports are wooden.

16. An adjustable hand grip according to claim 1 wherein the vertical supports are integrally molded from plastic.

17. An adjustable hand grip having a locking member for an orthopedic crutch with a pair of generally parallel, vertical supports rigidly attached to one another, with each of the supports having a plurality of spaced apertures along a longitudinal surface comprising:

a. a sleeve slidably surrounding each vertical support, each sleeve having an aperture that can be aligned with the apertures in the vertical support;

b. a bracket extending between the vertical supports to rigidly connect the sleeves; and c. a generally U-shaped clamp surrounding a portion of the sleeve with the legs having projections that extend inwardly to bias against the sleeve, the clamp having a pin insertable through aligned apertures in the sleeve and the vertical support and movable into and out of the aligned apertures, the clamp firmly fixing the hand grip to the vertical supports when the pin is extended through the aligned apertures in the sleeve and vertical support; and, d. stop means on the external surface of the sleeve which the projections on the clamp engage to limit the extent of movement of the clamp when the pin is moved out of the aperture in the vertical support.

18. The adjustable hand grip according to claim 17 wherein the external surface of said sleeve is further provided with a recess in which the projections on the legs of the clamp rest when the pin is moved into the aperture in the vertical supports.

19. The adjustable hand grip according to claim 18 further comprising finger rest means on the external surface of the clamp against which force may be applied to move the clamp away from the vertical support so as to move the pin out of the aperture in the vertical support.

20. The adjustable hand grip according to claim 19 wherein said clamp comprises a plastic material and said pin is metallic and is fixed to the clamp.

21. An adjustable hand grip according to claim 20 wherein the force required to displace the pin from the clamp is at least 10 pounds.

22. An orthopedic crutch comprising:

a pair of generally parallel, vertical tubular supports rigidly attached to one another, each of said tubular supports having a plurality of spaced apertures along a longitudinal surface;

an arm surface attached to the upper ends of said vertical supports;

a hand grip comprising a tubular sleeve surrounding each vertical support and slidable thereover and a bracket extending between the vertical supports rigidly connecting said sleeves, each sleeve having an aperture therethrough alignable with apertures in a vertical support;

a clamp surrounding a portion of the sleeve and having a pin insertable through aligned apertures in said sleeve and vertical support, said pin being fixed to the clamp and being movable into and out of said aligned apertures, said clamp firmly fixing said hand grip to said vertical supports when said pin is extended through the aligned apertures in the sleeve and vertical support;

said hand grip being vertically adjustable by moving said pins out of said vertical supports and sliding said sleeves along said vertical supports to enable said hand grip to be placed in position at an adjustable distance from said arm support and thereafter moving said pin into the closest pair of aligned apertures in said sleeves and vertical supports to fix the hand grip in the adjusted position.

23. An orthopedic crutch according to claim 22 where said clamp is generally U-shaped and at least a portion of the legs of the U-shaped clamp are biased against the sleeve in the disengaged position and in an over center lock condition when engaged.

24. An orthopedic crutch according to claim 23 wherein the portions of the legs of the U-shaped clamp that are biased against the sleeve comprise projections on the legs that extend inwardly.

25. An orthopedic crutch according to claim 24 further comprising stp means on the external surface of the sleeve which the projections on the clamp engage to limit the extent of movement of the clamp when said pin is moved out of the aperture in the vertical support.

26. An orthopedic crutch according to claim 25 further comprising finger rest means on the external surface of the clamp against which force may be applied to move the clamp away from the vertical support sao as to move the pin out of the aperture in the vertical support.

27. An orthopedic crutch according to claim 26 wherein said clamp comprises a plastic material and said pin is metallic.

28. An orthopedic crutch according to claim 22 wherein the force required to move the pin out of the aperture in the vertical support is greater than the force required to move the pin into the aperture in the vertical supports.

29. An orthopedic crutch according to claim 28 wherein the ratio of the force required to move the pin out of the aperture in the vertical support to the force required to move the pin into the aperture in the vertical supports ranges from 2:1 to 5:1.

30. An orthopedic crutch according to claim 28 wherein the force required to move the pin out of the aperture in the vertical support is at least about 0.5 pounds and the force required to move the pin into the aperture in the vertical support is at least about 0.1 pounds.

31. An orthopedic crutch according to claim 22 wherein the force required to displace the pin from the clamp is at least 10 pounds.

32. An orthopedic crutch according to claim 22 wherein the force to displace the pin from the clamp ranges from about 65 to about 300 pounds.

33. An orthopedic crutch according to claim 22 wherein the hand grip can withstand a static load of about 100 pounds with the load applied in the vertical direction while the crutch is oriented at about 15 degrees from the vertical.

34. An orthopedic crutch according to claim 22 wherein the apertures provided in the vertical supports can withstand a cyclic loading of about 100 pounds applied vertically to the hand grip while the crutch is oriented at about 15 degrees from the vertical for a minimum of 200,000 cycles without excessive enlargement or fatigue of related components.

35. An orthopedic crutch comprising:

a pair of generally parallel, vertical tubular supports rigidly attached to one another, each of said tubular supports having a plurality of spaced apertures along a longitudinal surface;

an arm support attached to the upper ends of said vertical supports;

a hand grip comprising a tubular sleeve surrounding each vertical support and slidable thereover and a bracket extending between the vertical supports rigidly connecting said sleeves, each sleeve having an aperture therethrough alignable with apertures in a vertical support;

a generally U-shaped clamp surrounding a portion of the sleeve with the legs having projections that extend inwardly against the sleeve in the disengaged position and in an over center lock condition when engaged and having a pin insertable through aligned apertures in said sleeve and vertical support, said pin being fixed to the clamp and being movable into and out of said aligned apertures, said clamp firmly fixing said hand grip to said vertical supports when said pin is extended through the aligned apertures in the sleeve and vertical support;

stop means on the external surface of the sleeve which the projections on the clamp engage to limit the extent of movement of the clamp when said pin is moved out of the aperture in the vertical support; and said hand grip being vertically adjustable by moving said pins out of said vertical supports and sliding said sleeves along said vertical supports to enable said hand grip to be placed in position at an adjustable distance from said arm support and thereafter moving said pin into the closest pair of aligned apertures in said sleeves and vertical supports to fix the hand grip in the adjusted position.

36. An orthopedic crutch according to claim 35 wherein the external surface of said sleeve is further provided with a recess in which the projections on the legs of the clamp rest when the pin is moved into the aperture in the vertical supports.

37. An orthopedic crutch according to claim 36 further comprising finger rest means on the external surface of the clamp against which force may be applied to move the clamp away from the vertical support so as to move the pin out of the aperture in the vertical support.

38. An orthopedic crutch according to claim 37 wherein said clamp comprises a plastic material and said pin is metallic.

39. An orthopedic crutch according to claim 38 wherein said plastic is polyethylene.

40. An orthopedic crutch according to claim 36 wherein said plastic is polyethylene.

* * * * *

UNITED STATES PATENT AND TRADEMARK OFFICE

CERTIFICATE OF CORRECTION

PATENT NO. : 5,291,910
DATED : March 8, 1994
INVENTOR(S) : Cuong Bui and Jim R. Schultz It is certified that error appears in the above-indentified patent and that said Letters Patent is hereby corrected as shown below:

IN THE ASSIGNEE: (Title page, item 76)

Delete "Guardian Products, Inc." and substitute therefor --Guardian Products Inc.--.

In column 3, line 59, delete "TM" and substitute therefor --™--.

In column 4, line 39, delete "rip" and substitute therefor --grip--.

IN THE CLAIMS

In claim 1, column 5, line 64, delete the word "for".

In claim 13, column 6, line 64, delete "cycle" and substitute therefor --cyclic--.

In claim 22, column 7, line 55, delete "surface" and substitute therefor --support--.

UNITED STATES PATENT AND TRADEMARK OFFICE

CERTIFICATE OF CORRECTION

PATENT NO. : 5,291,910
DATED : March 8, 1994
INVENTOR(S) : Cuong Bui and Jim R. Schultz It is certified that error appears in the above-indentified patent and that said Letters Patent is hereby corrected as shown below:

IN THE CLAIMS

In claim 25, column 8, line 21, delete "stp" and substitute therefor --stop--.

In claim 26, column 8, line 28, delete "sao" and substitute therefor --so--.

In claim 35, column 9, line 16, after the word "inwardly" insert --to bias--.

Signed and Sealed this

Twentieth Day of September, 1994

Bruce Lehman

*Attest:*

BRUCE LEHMAN

*Attesting Officer*

*Commissioner of Patents and Trademarks*